US008157026B2

(12) United States Patent
Kulkarni

(10) Patent No.: US 8,157,026 B2
(45) Date of Patent: Apr. 17, 2012

(54) HYBRID BIT WITH VARIABLE EXPOSURE

(75) Inventor: Ajay V. Kulkarni, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 112 days.

(21) Appl. No.: 12/487,561

(22) Filed: Jun. 18, 2009

(65) Prior Publication Data

US 2010/0320001 A1 Dec. 23, 2010

(51) Int. Cl.
*E21B 10/00* (2006.01)

(52) U.S. Cl. ..... 175/336; 175/335

(58) Field of Classification Search ..... 175/336, 175/376, 431

See application file for complete search history.

(56) References Cited

U.S. PATENT DOCUMENTS

| | | | |
|---|---|---|---|
| 930,759 | A | 8/1909 | Hughes |
| 1,388,424 | A | 9/1921 | George |
| 1,394,769 | A | 10/1921 | Sorensen |
| 1,519,641 | A | 12/1924 | Thompson |
| 1,816,568 | A | 7/1931 | Carlson |
| 1,821,474 | A | 9/1931 | Mercer |
| 1,874,066 | A | 8/1932 | Scott et al. |
| 1,879,127 | A | 9/1932 | Schlumpf |
| 1,896,243 | A | 2/1933 | Macdonald |
| 1,932,487 | A | 10/1933 | Scott |
| 2,030,722 | A | 2/1936 | Scott |
| 2,117,481 | A | 5/1938 | Howard et al. |
| 2,119,618 | A | 6/1938 | Zublin |
| 2,198,849 | A | 4/1940 | Waxler |
| 2,216,894 | A | 10/1940 | Stancliff |
| 2,244,537 | A | 6/1941 | Kammerer |
| 2,297,157 | A | 9/1942 | McClinton |
| 2,320,136 | A | 5/1943 | Kammerer |
| 2,320,137 | A | 5/1943 | Kammerer |
| 2,380,112 | A | 7/1945 | Kinnear |
| RE23,416 | E | 10/1951 | Kinnear |
| 2,719,026 | A | 9/1955 | Boice |

(Continued)

FOREIGN PATENT DOCUMENTS

| | | |
|---|---|---|
| DE | 13 01 784 | 8/1969 |

(Continued)

OTHER PUBLICATIONS

International Search Report for corresponding International patent application No. PCT/US2008/083532.

(Continued)

*Primary Examiner* — Kenneth L Thompson
*Assistant Examiner* — Ronald Runyan
(74) *Attorney, Agent, or Firm* — Sutton McAughan Deaver PLLC

(57) ABSTRACT

An earth boring drill bit comprising a bit body having a bit profile including nose, shoulder, and gage sections; a plurality of fixed cutting elements secured to the body and defining a fixed cutter profile; and a roller cone rotatably secured to the body, the roller cone having a plurality of roller cone cutting elements defining a roller cutter profile, wherein the fixed cutter profile extends beyond the roller cutter profile in at least one of the sections and the roller cutter profile extends beyond the fixed cutter profile in at least one of the sections. The roller cutter profile may extend beyond the fixed cutter profile in the shoulder and gage sections, possibly with the fixed cutter profile extending beyond the roller cutter profile in the nose section and/or a cone section.

15 Claims, 6 Drawing Sheets

U.S. PATENT DOCUMENTS

| | | | |
|---|---|---|---|
| 2,815,932 | A | 12/1957 | Wolfram |
| 2,994,389 | A | 8/1961 | Bus, Sr. |
| 3,010,708 | A | 11/1961 | Hlinsky et al. |
| 3,050,293 | A | 8/1962 | Hlinsky |
| 3,055,443 | A | 9/1962 | Edwards |
| 3,066,749 | A | 12/1962 | Hildebrandt |
| 3,126,066 | A | 3/1964 | Williams, Jr. |
| 3,126,067 | A | 3/1964 | Schumacher, Jr. |
| 3,174,564 | A | 3/1965 | Morlan |
| 3,239,431 | A | 3/1966 | Raymond |
| 3,250,337 | A | 5/1966 | Demo |
| 3,269,469 | A | 8/1966 | Kelly, Jr. |
| 3,387,673 | A | 6/1968 | Thompson |
| 3,424,258 | A | 1/1969 | Nakayama |
| 3,583,501 | A | 6/1971 | Aalund |
| RE28,625 | E | 11/1975 | Cunningham |
| 4,006,788 | A | 2/1977 | Garner |
| 4,140,189 | A | 2/1979 | Garner |
| 4,190,126 | A | 2/1980 | Kabashima |
| 4,270,812 | A | 6/1981 | Thomas |
| 4,285,409 | A | 8/1981 | Allen |
| 4,293,048 | A | 10/1981 | Kloesel, Jr. |
| 4,320,808 | A | 3/1982 | Garrett |
| 4,343,371 | A | 8/1982 | Baker, III et al. |
| 4,359,112 | A | 11/1982 | Garner et al. |
| 4,369,849 | A | 1/1983 | Parrish |
| 4,386,669 | A | 6/1983 | Evans |
| 4,410,284 | A | 10/1983 | Herrick |
| 4,428,687 | A | 1/1984 | Zahradnik |
| 4,444,281 | A | 4/1984 | Schumacher, Jr. et al. |
| 4,527,637 | A | 7/1985 | Bodine |
| 4,572,306 | A | 2/1986 | Dorosz |
| 4,657,091 | A | 4/1987 | Higdon |
| 4,664,705 | A | 5/1987 | Horton et al. |
| 4,690,228 | A | 9/1987 | Voelz et al. |
| 4,706,765 | A | 11/1987 | Lee et al. |
| 4,726,718 | A | 2/1988 | Meskin et al. |
| 4,727,942 | A | 3/1988 | Galle et al. |
| 4,738,322 | A | 4/1988 | Hall et al. |
| 4,765,205 | A | 8/1988 | Higdon |
| 4,874,047 | A | 10/1989 | Hixon |
| 4,875,532 | A | 10/1989 | Langford, Jr. |
| 4,892,159 | A | 1/1990 | Holster |
| 4,915,181 | A | 4/1990 | Labrosse |
| 4,932,484 | A | 6/1990 | Warren et al. |
| 4,936,398 | A | 6/1990 | Auty et al. |
| 4,943,488 | A | 7/1990 | Sung et al. |
| 4,953,641 | A | 9/1990 | Pessier |
| 4,976,324 | A | 12/1990 | Tibbitts |
| 4,984,643 | A | 1/1991 | Isbell et al. |
| 4,991,671 | A | 2/1991 | Pearce et al. |
| 5,016,718 | A | 5/1991 | Tandberg |
| 5,027,912 | A | 7/1991 | Juergens |
| 5,028,177 | A | 7/1991 | Meskin et al. |
| 5,030,276 | A | 7/1991 | Sung et al. |
| 5,049,164 | A | 9/1991 | Horton et al. |
| 5,116,568 | A | 5/1992 | Sung et al. |
| 5,145,017 | A | 9/1992 | Holster et al. |
| 5,176,212 | A | 1/1993 | Tandberg |
| 5,224,560 | A | 7/1993 | Fernandez |
| 5,238,074 | A | 8/1993 | Tibbitts et al. |
| 5,287,936 | A | 2/1994 | Grimes et al. |
| 5,289,889 | A | 3/1994 | Gearhart et al. |
| 5,337,843 | A | 8/1994 | Torgrimsen et al. |
| 5,346,026 | A | 9/1994 | Pessier et al. |
| 5,351,770 | A | 10/1994 | Cawthorne et al. |
| 5,361,859 | A | 11/1994 | Tibbitts |
| 5,429,200 | A | 7/1995 | Blackman et al. |
| 5,439,068 | A | 8/1995 | Huffstutler et al. |
| 5,452,771 | A | 9/1995 | Blackman et al. |
| 5,467,836 | A | 11/1995 | Grimes et al. |
| 5,472,057 | A | 12/1995 | Winfree |
| 5,472,271 | A | 12/1995 | Bowers et al. |
| 5,513,715 | A | 5/1996 | Dysart |
| 5,518,077 | A | 5/1996 | Blackman et al. |
| 5,547,033 | A | 8/1996 | Campos, Jr. |
| 5,553,681 | A | 9/1996 | Huffstutler et al. |
| 5,558,170 | A | 9/1996 | Thigpen et al. |
| 5,560,440 | A | 10/1996 | Tibbitts |
| 5,570,750 | A | 11/1996 | Williams |
| 5,593,231 | A | 1/1997 | Ippolito |
| 5,606,895 | A | 3/1997 | Huffstutler |
| 5,624,002 | A | 4/1997 | Huffstutler |
| 5,641,029 | A | 6/1997 | Beaton et al. |
| 5,644,956 | A | 7/1997 | Blackman et al. |
| 5,655,612 | A | 8/1997 | Grimes et al. |
| D384,084 | S | 9/1997 | Huffstutler et al. |
| 5,695,018 | A | 12/1997 | Pessier et al. |
| 5,695,019 | A | 12/1997 | Shamburger, Jr. |
| 5,755,297 | A | 5/1998 | Young et al. |
| 5,862,871 | A | 1/1999 | Curlett |
| 5,868,502 | A | 2/1999 | Cariveau et al. |
| 5,873,422 | A | 2/1999 | Hansen et al. |
| 5,941,322 | A | 8/1999 | Stephenson et al. |
| 5,944,125 | A | 8/1999 | Byrd |
| 5,967,246 | A | 10/1999 | Caraway et al. |
| 5,979,576 | A | 11/1999 | Hansen et al. |
| 5,988,303 | A | 11/1999 | Arfele |
| 5,992,542 | A | 11/1999 | Rives |
| 5,996,713 | A | 12/1999 | Pessier et al. |
| 6,092,613 | A | 7/2000 | Caraway et al. |
| 6,095,265 | A | 8/2000 | Alsup |
| 6,109,375 | A | 8/2000 | Tso |
| 6,116,357 | A | 9/2000 | Wagoner et al. |
| 6,173,797 | B1 | 1/2001 | Dykstra et al. |
| 6,220,374 | B1 | 4/2001 | Crawford |
| 6,241,034 | B1 | 6/2001 | Steinke et al. |
| 6,241,036 | B1 | 6/2001 | Lovato et al. |
| 6,250,407 | B1 | 6/2001 | Karlsson |
| 6,260,635 | B1 | 7/2001 | Crawford |
| 6,279,671 | B1 | 8/2001 | Panigrahi et al. |
| 6,283,233 | B1 | 9/2001 | Lamine et al. |
| 6,296,069 | B1 | 10/2001 | Lamine et al. |
| RE37,450 | E | 11/2001 | Deken et al. |
| 6,345,673 | B1 | 2/2002 | Siracki |
| 6,360,831 | B1 | 3/2002 | Akesson et al. |
| 6,367,568 | B2 | 4/2002 | Steinke et al. |
| 6,386,302 | B1 | 5/2002 | Beaton |
| 6,401,844 | B1 | 6/2002 | Doster et al. |
| 6,405,811 | B1 | 6/2002 | Borchardt |
| 6,408,958 | B1 | 6/2002 | Isbell et al. |
| 6,415,687 | B2 | 7/2002 | Saxman |
| 6,439,326 | B1 | 8/2002 | Huang et al. |
| 6,446,739 | B1 | 9/2002 | Richman et al. |
| 6,450,270 | B1 | 9/2002 | Saxton |
| 6,460,635 | B1 | 10/2002 | Kalsi et al. |
| 6,474,424 | B1 | 11/2002 | Saxman |
| 6,510,906 | B1 | 1/2003 | Richert et al. |
| 6,510,909 | B2 | 1/2003 | Portwood et al. |
| 6,527,066 | B1 | 3/2003 | Rives |
| 6,533,051 | B1 | 3/2003 | Singh et al. |
| 6,544,308 | B2 | 4/2003 | Griffin et al. |
| 6,562,462 | B2 | 5/2003 | Griffin et al. |
| 6,568,490 | B1 | 5/2003 | Tso et al. |
| 6,581,700 | B2 | 6/2003 | Curlett et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,661 | B2 | 8/2003 | Baker et al. |
| 6,601,662 | B2 | 8/2003 | Matthias et al. |
| 6,684,967 | B2 | 2/2004 | Mensa-Wilmot et al. |
| 6,729,418 | B2 | 5/2004 | Slaughter, Jr. et al. |
| 6,739,214 | B2 | 5/2004 | Griffin et al. |
| 6,742,607 | B2 | 6/2004 | Beaton |
| 6,745,858 | B1 | 6/2004 | Estes |
| 6,749,033 | B2 | 6/2004 | Griffin et al. |
| 6,797,326 | B2 | 9/2004 | Griffin et al. |
| 6,823,951 | B2 | 11/2004 | Yong et al. |
| 6,843,333 | B2 | 1/2005 | Richert et al. |
| 6,861,098 | B2 | 3/2005 | Griffin et al. |
| 6,861,137 | B2 | 3/2005 | Griffin et al. |
| 6,878,447 | B2 | 4/2005 | Griffin et al. |
| 6,883,623 | B2 | 4/2005 | McCormick et al. |
| 6,902,014 | B1 | 6/2005 | Estes |
| 6,986,395 | B2 | 1/2006 | Chen |
| 6,988,569 | B2 | 1/2006 | Lockstedt et al. |
| 7,096,978 | B2 | 8/2006 | Dykstra et al. |

| | | | | |
|---|---|---|---|---|
| 7,111,694 | B2 | 9/2006 | Beaton | |
| 7,137,460 | B2 | 11/2006 | Slaughter, Jr. et al. | |
| 7,152,702 | B1 | 12/2006 | Bhome et al. | |
| 7,197,806 | B2 | 4/2007 | Boudreaux et al. | |
| 7,198,119 | B1 | 4/2007 | Hall et al. | |
| 7,234,550 | B2 | 6/2007 | Azar et al. | |
| 7,270,196 | B2 | 9/2007 | Hall | |
| 7,281,592 | B2 | 10/2007 | Runia et al. | |
| 7,320,375 | B2 | 1/2008 | Singh | |
| 7,350,568 | B2 | 4/2008 | Mandal et al. | |
| 7,350,601 | B2 | 4/2008 | Belnap et al. | |
| 7,360,612 | B2 | 4/2008 | Chen et al. | |
| 7,377,341 | B2 | 5/2008 | Middlemiss et al. | |
| 7,387,177 | B2 | 6/2008 | Zahradnik et al. | |
| 7,392,862 | B2 | 7/2008 | Zahradnik et al. | |
| 7,398,837 | B2 | 7/2008 | Hall et al. | |
| 7,416,036 | B2 | 8/2008 | Forstner et al. | |
| 7,435,478 | B2 | 10/2008 | Keshavan | |
| 7,462,003 | B2 | 12/2008 | Middlemiss | |
| 7,473,287 | B2 | 1/2009 | Belnap et al. | |
| 7,493,973 | B2 | 2/2009 | Keshavan et al. | |
| 7,517,589 | B2 | 4/2009 | Eyre | |
| 7,533,740 | B2 | 5/2009 | Zhang et al. | |
| 7,568,534 | B2 | 8/2009 | Griffin et al. | |
| 7,621,346 | B1 | 11/2009 | Trinh et al. | |
| 7,621,348 | B2 | 11/2009 | Hoffmaster et al. | |
| 7,703,556 | B2 | 4/2010 | Smith et al. | |
| 7,703,557 | B2 | 4/2010 | Durairajan et al. | |
| 7,819,208 | B2 | 10/2010 | Pessier et al. | |
| 7,836,975 | B2 | 11/2010 | Chen et al. | |
| 7,845,435 | B2 | 12/2010 | Zahradnik et al. | |
| 7,845,437 | B2 | 12/2010 | Bielawa et al. | |
| 7,847,437 | B2 | 12/2010 | Chakrabarti et al. | |
| 2002/0092684 | A1 | 7/2002 | Singh et al. | |
| 2002/0108785 | A1 | 8/2002 | Slaughter, Jr. et al. | |
| 2004/0099448 | A1 | 5/2004 | Fielder et al. | |
| 2004/0238224 | A1 | 12/2004 | Runia | |
| 2005/0087370 | A1 | 4/2005 | Ledgerwood, III et al. | |
| 2005/0103533 | A1 | 5/2005 | Sherwood et al. | |
| 2005/0178587 | A1 | 8/2005 | Witman, IV et al. | |
| 2005/0183892 | A1 | 8/2005 | Oldham et al. | |
| 2005/0263328 | A1 | 12/2005 | Middlemiss | |
| 2005/0273301 | A1 | 12/2005 | Huang | |
| 2006/0032674 | A1 | 2/2006 | Chen et al. | |
| 2006/0032677 | A1 | 2/2006 | Azar et al. | |
| 2006/0162969 | A1 | 7/2006 | Belnap et al. | |
| 2006/0196699 | A1 | 9/2006 | Estes et al. | |
| 2006/0254830 | A1 | 11/2006 | Radtke | |
| 2006/0266558 | A1 | 11/2006 | Middlemiss et al. | |
| 2006/0266559 | A1 | 11/2006 | Keshavan et al. | |
| 2006/0278442 | A1 | 12/2006 | Kristensen | |
| 2006/0283640 | A1 | 12/2006 | Estes et al. | |
| 2007/0029114 | A1 | 2/2007 | Middlemiss | |
| 2007/0062736 | A1 | 3/2007 | Cariveau et al. | |
| 2007/0079994 | A1 | 4/2007 | Middlemiss | |
| 2007/0187155 | A1 | 8/2007 | Middlemiss | |
| 2007/0221417 | A1 | 9/2007 | Hall et al. | |
| 2008/0066970 | A1 | 3/2008 | Zahradnik et al. | |
| 2008/0264695 | A1* | 10/2008 | Zahradnik et al. | 175/336 |
| 2008/0296068 | A1* | 12/2008 | Zahradnik et al. | 175/341 |
| 2009/0114454 | A1 | 5/2009 | Belnap et al. | |
| 2009/0120693 | A1 | 5/2009 | McClain et al. | |
| 2009/0126998 | A1 | 5/2009 | Zahradnik et al. | |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0183925 | A1 | 7/2009 | Zhang et al. | |
| 2009/0272582 | A1 | 11/2009 | McCormick et al. | |
| 2010/0224417 | A1 | 9/2010 | Zahradnik et al. | |
| 2010/0276205 | A1 | 11/2010 | Oxford et al. | |
| 2010/0288561 | A1 | 11/2010 | Zahradnik et al. | |
| 2010/0320001 | A1 | 12/2010 | Kulkarni | |
| 2011/0024197 | A1 | 2/2011 | Centala et al. | |
| 2011/0079440 | A1 | 4/2011 | Buske et al. | |
| 2011/0079441 | A1 | 4/2011 | Buske et al. | |
| 2011/0079442 | A1 | 4/2011 | Buske et al. | |
| 2011/0079443 | A1 | 4/2011 | Buske et al. | |
| 2011/0162893 | A1 | 7/2011 | Zhang | |

FOREIGN PATENT DOCUMENTS

| | | |
|---|---|---|
| EP | 0225101 | 6/1987 |
| EP | 0157278 | 11/1989 |
| EP | 0391683 | 1/1996 |
| EP | 0874128 | 10/1998 |
| EP | 2089187 | 8/2009 |
| GB | 2183694 | 6/1987 |
| JP | 2000080878 | 3/2000 |
| JP | 2001159289 | 6/2001 |
| SU | 1 331 988 | 8/1987 |
| WO | 8502223 | 5/1985 |
| WO | 2008124572 | 10/2008 |

OTHER PUBLICATIONS

Written Opinion for corresponding International patent application No. PCT/US2008/083532.

Sheppard, N. and Dolly, B. "Rock Drilling—Hybrid Bit Success for Syndax3 Pins." Industrial Diamond Review, Jun. 1993, pp. 309-311.

Tomlinson, P. and Clark, I. "Rock Drilling—Syndax3 Pins-New Concepts in PCD Drilling." Industrial Diamond Review, Mar. 1992, pp. 109-114.

Williams, J. and Thompson, A. "An Analysis of the Performance of PDC Hybrid Drill Bits." SPE/IADC 16117, SPE/IADC Drilling Conference, Mar. 1987, pp. 585-594.

Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.

Smith Services. "Hole Opener—Model 6980 Hole Opener." [retrieved from the Internet on May 7, 2008 using <URL: http://www.siismithservices.com/b_products/product_page.asp?ID=589>].

Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].

Ersoy, A. and Waller, M. "Wear characteristics of PDC pin and hybrid core bits in rock drilling." Wear 188, Elsevier Science S.A., Mar. 1995, pp. 150-165.

S.H. Kim, International Search Report for International Patent Application No. PCT/US2009/067969, Korean Intellectual Property Office, dated May 25, 2010.

S.H. Kim, Written Opinion for International Patent Application No. PCT/US2009/067969, Korean Intellectual Property Office, dated May 25, 2010.

Sung Joon Lee, International Search Report for International Patent Application No. PCT/US2009/050672, Korean Intellectual Property Office, dated Mar. 3, 2010.

Sung Joon Lee, Written Opinion for International Patent Application No. PCT/US2009/050672, Korean Intellectual Property Office, dated Mar. 3, 2010.

Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.

Kang, K.H., International Search Report for International Patent Application No. PCT/US2010/033513, Korean Intellectual Property Office, dated Jan. 10, 2011.

Kang, K.H., Written Opinion for International Patent Application No. PCT/US2010/033513, Korean Intellectual Property Office, dated Jan. 10, 2011.

Kang, M.S., International Search Report for International Patent Application No. PCT/US2010/032511, Korean Intellectual Property Office, dated Jan. 17, 2011.

Kang, M.S., Written Opinion for International Patent Application No. PCT/US2010/032511, Korean Intellectual Property Office, dated Jan. 17, 2011.

Choi, J.S., International Search Report for International Patent Application No. PCT/US2010/039100, Korean Intellectual Property Office, dated Jan. 25, 2011.

Choi, J.S., Written Opinion for International Patent Application No. PCT/US2010/039100, Korean Intellectual Property Office, dated Jan. 25, 2011.

Baharlou, S., International Preliminary Report on Patentability, The International Bureau of WIPO, dated Jan. 25, 2011.

Jung Hye Lee, International Search Report for International Patent Application No. PCT/US2009/042514, Korean Intellectual Property Office, dated Nov. 27, 2009.
Jung Hye Lee, Written Opinion for International Patent Application No. PCT/US2009/042514, Korean Intellectual Property Office, dated Nov. 27, 2009.
Beijer, G., International Preliminary Report on Patentability for International Patent Application No. PCT/US2009/042514, The International Bureau of WIPO, dated Nov. 2, 2010.
R. Buske, C. Rickabaugh, J. Bradford, H. Lukasewich and J. Overstreet. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.
Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.
B. George, E. Grayson, R. Lays, F. Felderhoff, M. Doster and M. Holmes. "Significant Cost Savings Achieved Through the Use of PDC Bits in Compressed Air/Foam Applications." Society of Petroleum Engineers—SPE 116118, 2008 SPE Annual Technical Conference and Exhibition, Denver, Colorado, Sep. 21-24, 2008.
Georgescu, M., International Search Report for International Patent Application No. PCT/US2010/051019, dated Jun. 6, 2011, European Patent Office.
Georgescu, M., Written Opinion for International Patent Application No. PCT/US20101051019, dated Jun. 6, 2011, European Patent Office.
Georgescu, M., International Search Report for International Patent Application No. PCT/US2010/051020, dated Jun. 1, 2011, European Patent Office.
Georgescu, M., Written Opinion for International Patent Application No. PCT/US20101051020, dated Jun. 1, 2011, European Patent Office.
Georgescu, M., International Search Report for International Patent Application No. PCT/US2010/051017, dated Jun. 8, 2011, European Patent Office.
Georgescu, M., Written Opinion for International Patent Application No. PCT/US20101051017, dated Jun. 8, 2011, European Patent Office.
Georgescu, M., International Search Report for International Patent Application No. PCT/US2010/051014, dated Jun. 9, 2011, European Patent Office.
Georgescu, M., Written Opinion for International Patent Application No. PCT/US2010/051014, dated Jun. 9, 2011, European Patent Office.
Georgescu, M., International Search Report for International Patent Application No. PCT/US2010/050631, dated Jun. 10, 2011, European Patent Office.
Georgescu, M., Written Opinion for International Patent Application No. PCT/US2010/050631, dated Jun. 10, 2011, European Patent Office.
Becamel, P., International Preliminary Report on Patentability, dated Jan. 5, 2012, The International Bureau of WIPO, Switzerland.

* cited by examiner

HYBRID BIT WITH VARIABLE EXPOSURE

CROSS REFERENCE TO RELATED APPLICATIONS

None.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to hybrid drill bits; and more specifically relate to hybrid drill bits with both roller cone cutting elements and fixed blade cutting elements.

2. Description of the Related Art

U.S. Pat. No. 5,558,170 teaches a "drag bit having a plurality of blades or ribs on its end face has one or more pockets milled into the top surfaces of said blades. A tungsten carbide button or insert is positioned at the gauge diameter to reduce impact on the gauge diameter cutter in each of the fibs. The tungsten carbide button extends to the borehole gauge diameter to stabilize the bit within the borehole to limit bit whirling. The tungsten carbide button extends just forward of at least the final cutter assembly with respect to the direction of bit rotation to take the impact instead of the cutters. An additional tungsten carbide button or a shaped cutter is used along the blades in line with PDC cutting assemblies for limiting the penetration of the PDC cutting assemblies to thereby limit bit whirling or tilting instabilities. A shaped PDC cutter has a beveled edge with a bevel angle greater than the backrake angle of the PDC cutter so that engagement with the borehole wall is made with the tungsten carbide body rather than the PDC cutting portion to thereby function as a penetration limiter. As the bit wears, the PDC cutting portion begins to engage the formation in the same manner as the other PDC cutting assemblies."

U.S. Pat. No. 6,684,967 teaches a "drill bit including improved gage pads is particularly adapted for side cutting a borehole wall. In a preferred embodiment, the drill bit gage pads alternate between an active gage pad with a cutting surface portion and a non-active gage pad with a wear-resistant surface. Gage pad cutting elements placed on a first active gage pad cooperate with gage pad cutting elements placed on other active gage pads. What results is a contiguous series of overlapping cutting elements suitable to cut the borehole wall. Non-active gage pads are preferably placed between the active cutting gage pads. These non-active gage pads have a wear-resistant surface (such as steel or diamond insert) that extends to the gage diameter. These non-active gage pads help to maintain borehole size and prevent undue torque being placed on the drill bit."

U.S. Patent Application Publication No. 20080264695 teaches a "hybrid drill bit having both roller cones and fixed blades is disclosed, and a method of drilling. The cutting elements on the fixed blades form a continuous cutting profile from the perimeter of the bit body to the axial center. The roller cone cutting elements overlap with the fixed cutting elements in the nose and shoulder sections of the cutting profile between the axial center and the perimeter. The roller cone cutting elements crush and pre- or partially fracture formation in the confined and highly stressed nose and shoulder sections."

U.S. Patent Application Publication No. 20090126998 teaches a "hybrid earth-boring bit comprising a bit body having a central axis, at least one, preferably three fixed blades, depending downwardly from the bit body, each fixed blade having a leading edge, and at least one rolling cutter, preferably three rolling cutters, mounted for rotation on the bit body. A rolling cutter is located between two fixed blades."

The inventions disclosed and taught herein are directed to an improved earth boring drill bit.

BRIEF SUMMARY OF THE INVENTION

An earth boring drill bit comprising a bit body having a bit profile including a number of sections, such as cone, nose, shoulder, and gage sections; a plurality of fixed cutting elements secured to the body and defining a fixed cutter profile; and a roller cone rotatably secured to the body, the roller cone having a plurality of roller cone cutting elements defining a roller cutter profile, wherein the fixed cutter profile extends beyond the roller cutter profile in at least one of the sections and the roller cutter profile extends beyond the fixed cutter profile in at least one of the sections. The roller cutter profile may extend beyond the fixed cutter profile in the shoulder and gage sections, possibly with the fixed cutter profile extending beyond the roller cutter profile in the nose section and/or a cone section. Alternatively, the fixed cutter profile may extend beyond the roller cutter profile in the shoulder and gage sections possibly with the roller cutter profile extending beyond the fixed cutter profile in the nose section and or a cone section.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created an earth boring drill bit comprising a bit body having a bit profile including a number of sections, such as cone, nose, shoulder, and gage sections; a plurality of fixed cutting elements secured to the body and defining a fixed cutter profile; and a roller cone rotatably secured to the body, the roller cone having a plurality of roller cone cutting elements defining a roller cutter profile, wherein the fixed cutter profile extends beyond the roller cutter profile in at least one of the sections and the roller cutter profile extends beyond the fixed cutter profile in at least one of the sections. The roller cutter profile may extend beyond the fixed cutter profile in the shoulder and gage sections, possibly with the fixed cutter profile extending beyond the roller cutter profile in the nose section and/or a cone section. Alternatively, the fixed cutter profile may extend beyond the roller cutter profile in the shoulder and gage sections possibly with the roller cutter profile extending beyond the fixed cutter profile in the nose section and or a cone section.

Figure 1:
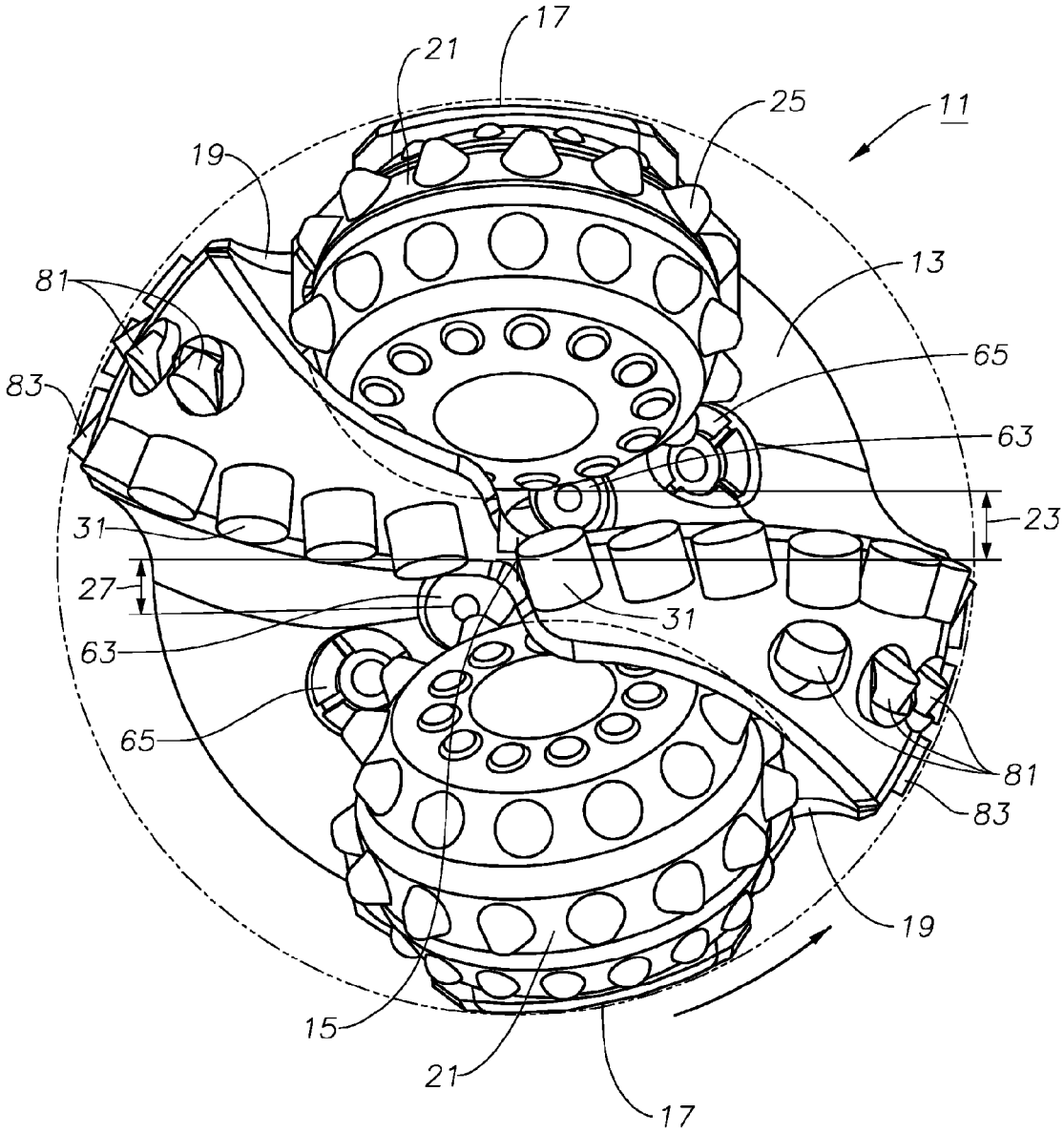
FIG. 1 illustrates a bottom plan view of an embodiment of the hybrid earth-boring bit constructed utilizing certain aspects of the present inventions.
Figure 2:
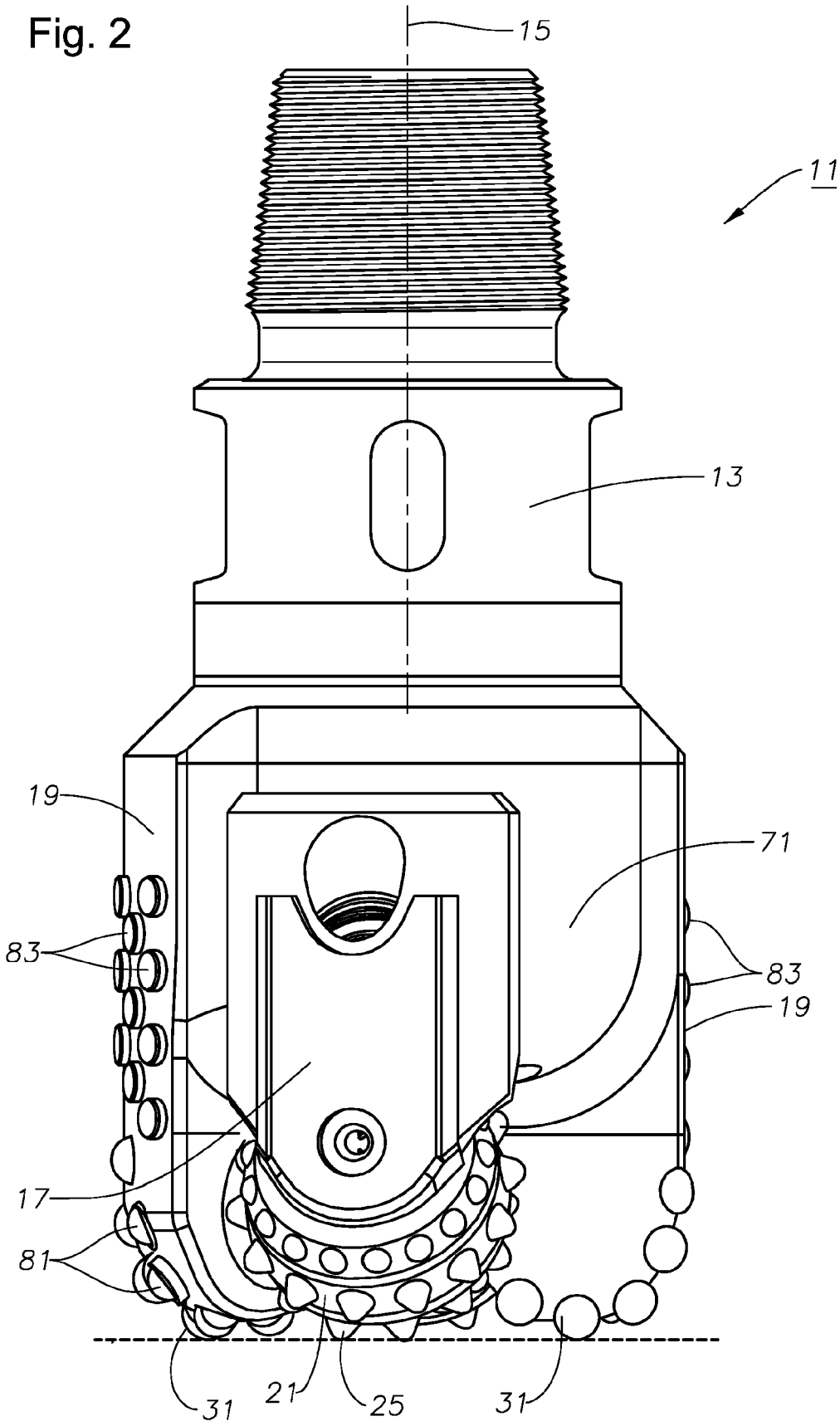
FIG. 2 illustrates a side elevation view of the embodiment of the hybrid earth-boring bit of FIG. 1 constructed utilizing certain aspects of the present inventions.
Figure 3:
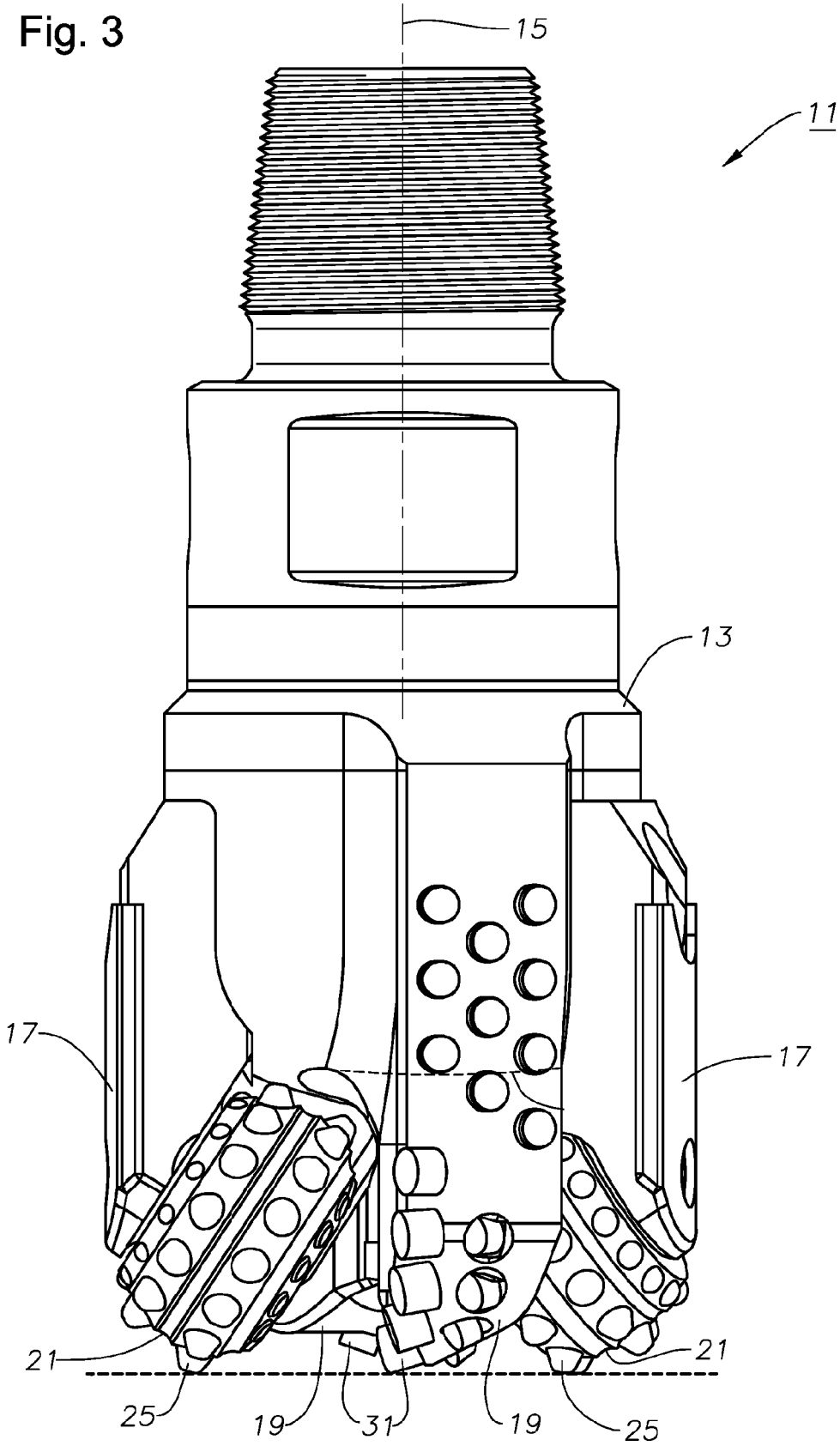
FIG. 3 illustrates another side elevation view of the hybrid earth-boring bit of FIG. 1 constructed utilizing certain aspects of the present inventions.

FIGS. 1-3 illustrate a hybrid bit 11 that incorporates both rolling cones and fixed polycrystalline diamond compact (PDC) cutters mounted on dual cutting structures, similar to that shown in U.S. Patent Application Publication No. 20080296068, which is incorporated herein by specific reference. More specifically, the bit 11 comprises a bit body 13 having a longitudinal axis 15 that defines an axial center of the bit body 13. A plurality of roller cone support arms 17 may extend from the bit body 13 in the longitudinal axial direction. The bit body 13 may also have a plurality of blades 19 that extend in the longitudinal axial direction. The number of each of arms 17 and blades 19 is preferably at least one but may be two or more. In one embodiment, as shown, there are two arms 17 and two blades 19.

Roller cones 21 are mounted to respective ones of the arms 17. A plurality of roller cone cutting elements, cutting inserts, or cutters 25, such as tungsten carbide inserts (TCI) or Steel Tooth inserts, may be mounted to, or milled into, the roller cones 21. In this manner, the roller cone cutters 25 may be rotatably mounted to the bit body 13. In addition, a plurality of fixed cutting elements 31, such as PDC cutters, may be fixedly mounted to the blades 19. Radial distances 23,27 may vary according to the application and bit size, and may vary from cone to cone, and/or cutting element to cutting element, an objective being to leave removal of formation material at the center of the borehole to the fixed-blade cutting elements 31, rather than the rolling-cutter cutting elements 25.

Nozzles 63,65 are generally centrally located in receptacles in the bit body 13. In connection with the nozzles 63,65, a pair of junk slots 71 are provided between the trailing side of each rolling cutter 21, and the leading edge of each fixed blade 19 (leading and trailing are defined with reference to the direction of rotation of the bit 11). Junk slots 71 provide a generally unobstructed area or volume for clearance of cuttings and drilling fluid from the central portion of the bit 11 to its periphery for return of these materials to the surface. Backup cutters 81 may be radially spaced along the blade 19 to concentrate their effect in nose, shoulder, and gage areas, which are discussed in greater detail below. In addition to backup cutters 81, a plurality of wear-resistant elements 83 may be present on the gage surface at the outermost periphery of each blade 19 to resist wear of the blade 19.

Figure 4:
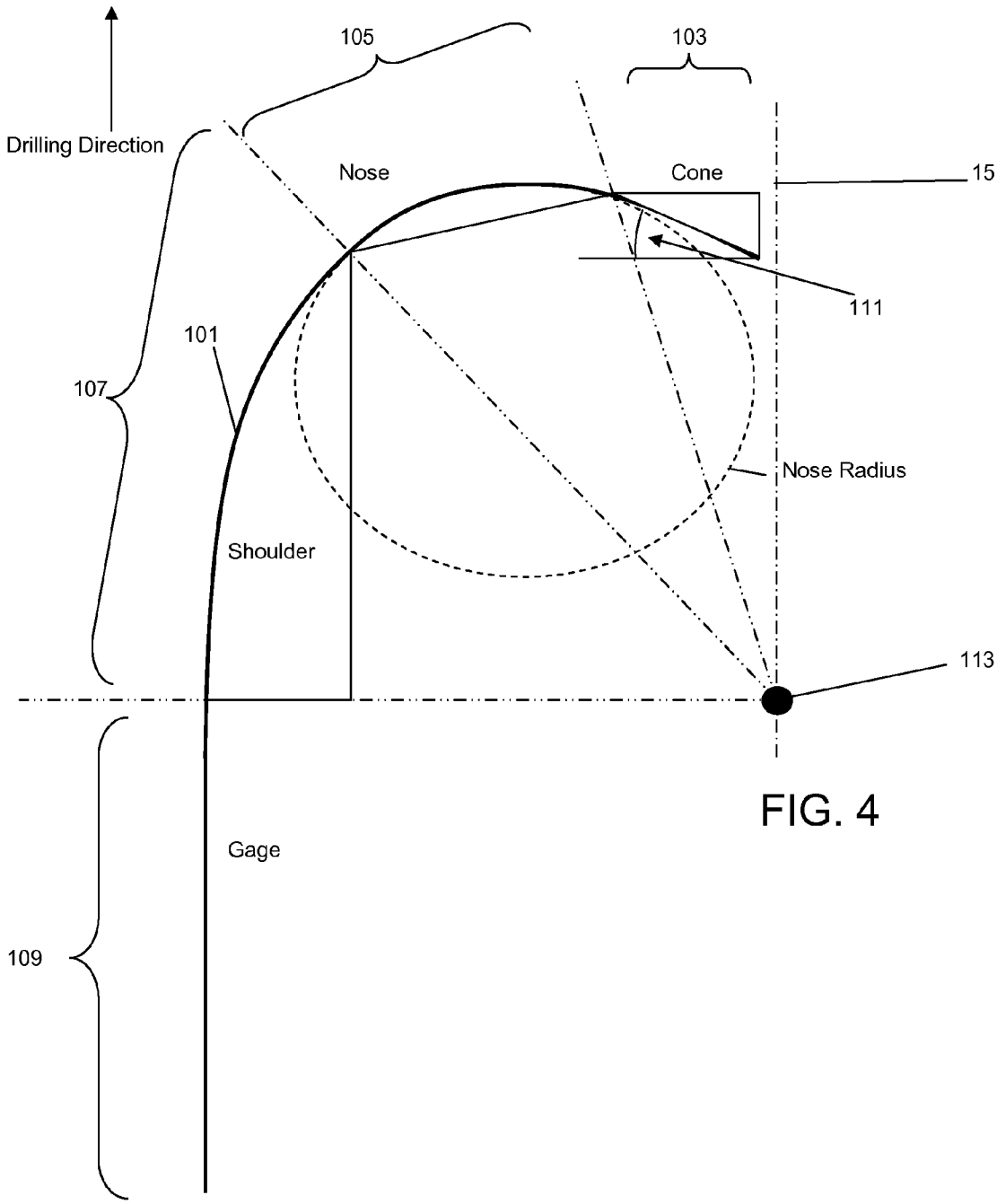
FIG. 4 illustrates a partial bit profile of the hybrid earth-boring bit of FIG. 1 constructed utilizing certain aspects of the present inventions.

Referring also to FIG. 4, the blades 19, or some other structure of the bit 11, preferably define a bit profile 101, which may include a cone section 103, nose section 105, a shoulder section 107, and a gage section 109. The cone section 103 is preferably a substantially linear section extending from near the center-line 15 of the drill bit 11 outward. The cone section 103 forms a cone angle 111 with a horizontal bottom of the borehole of typically between about 10 and 30 degrees, preferably about 20 degrees. However, in more extreme examples, the angle 111 could be virtually any value from −90 to +90 degrees.

The nose represents the lowest point on a drill bit. Therefore, the nose cutter is typically the leading most cutter. The nose section 105 is roughly defined by a nose radius. A larger nose radius provides more area to place cutters in the nose section 105. The nose section 105 begins where the cone section 103 ends, where the curvature of the blade begins, and extends to the shoulder section 107. More specifically, the nose section 105 extends where the bit profile 101 substantially matches a circle formed by the nose radius. The nose section 105 experiences much more, and more rapid, relative movement than does the cone section 103. Additionally, the nose section 105 typically takes more weight than the other sections. As such, the nose section 105 often experiences much more wear than does the cone section 103.

The shoulder section 107 begins where the bit profile 101 departs from the nose radius and continues outwardly on each blade 19 to a point where a slope of the blade 19 is essentially completely vertical, at the gage section 109. The shoulder section 107 experiences much more, and more rapid, relative movement than does the cone section 103. Additionally, the shoulder section 107 typically takes the brunt of abuse from dynamic dysfunction, such as bit whirl. As such, the shoulder section 107 experiences much more wear than does the cone section 103. The shoulder section 107 is also a more significant contributor to rate of penetration and drilling efficiency than the cone section 103. Depending on application, the nose section 105 or the shoulder section 107 may experience the most wear.

The gage section 109 begins where the shoulder section 107 ends. More specifically, the gage section 109 begins where the slope of the blade 19 is predominantly vertical. The gage section 109 continues outwardly to an outer perimeter or gauge of the drill bit 11. The gage section 109 experiences the most, and most rapid, relative movement with respect to the earth formation. However, at least partially because of the high, substantially vertical, slope of the blade 19 in the gage section 109, the gage section 109 does not typically experience as much wear as does the shoulder section 107 and/or the nose section 105. The gage section 109 does, however, typically experience more wear than the cone section 103.

Figure 5:
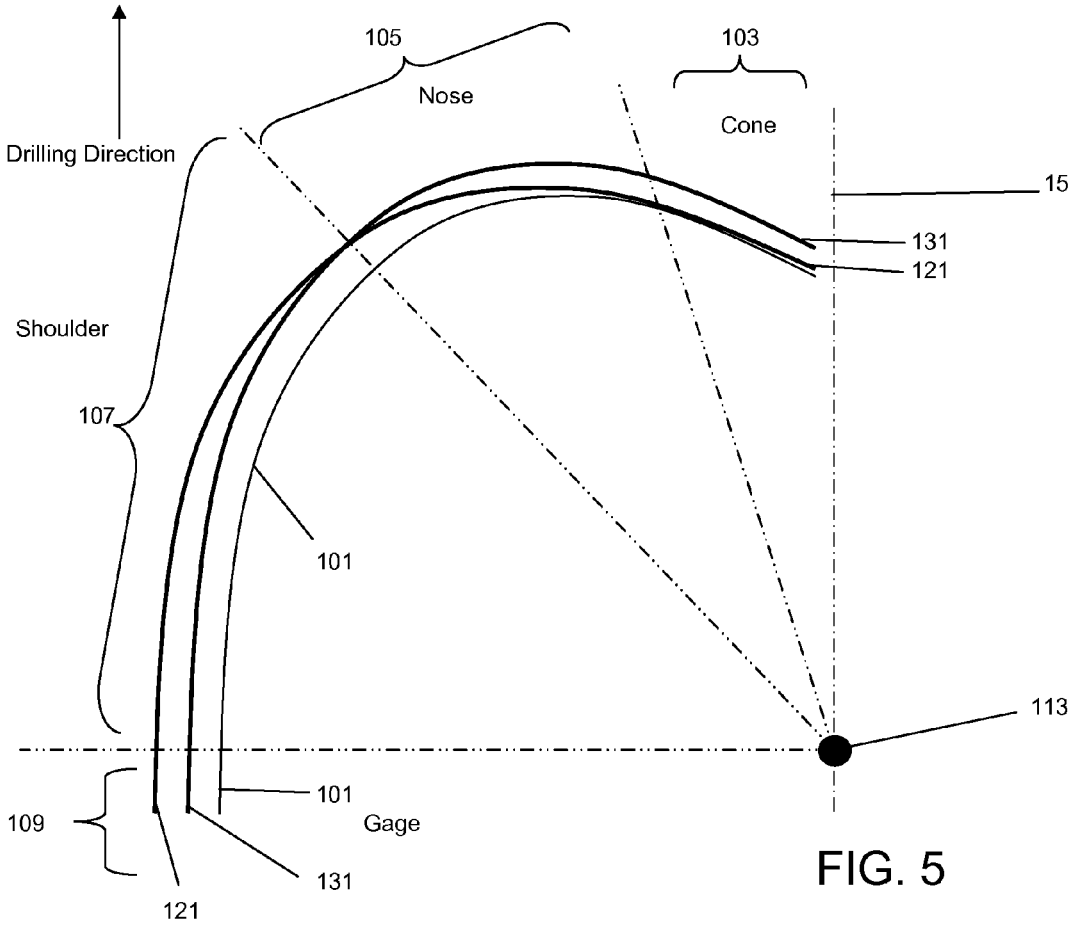
FIG. 5 illustrates a preferred relationship between a fixed cutter profile and a roller cutter profile utilizing certain aspects of the present inventions.

Referring also to FIG. 5, the fixed-blade cutting elements 31 typically extend outwardly from the bit profile 101, forming a fixed cutter profile 131. The fixed cutter profile 131 often, but not necessarily, matches the bit profile 101. For example, the fixed cutter profile 131 may share a similar curvature as the bit profile 101, but be offset therefrom. In some embodiments, the fixed cutter profile 131 may even define the bit profile 101. In any case, the fixed cutter profile 131 preferably extends through the cone section 103, the nose section 105, the shoulder section 107, and the gage section 109. However, in alternative embodiments, the fixed cutter profile 131 may only extend through one or more of the sections.

Additionally, the rolling-cutter cutting elements 25 typically extend outwardly from the bit profile 101, forming a roller cutter profile 121. The roller cutter profile 121 may also be similar to and/or offset from the bit profile 101 and/or the fixed cutter profile 131, through any of the sections. For example, the roller cutter profile 121 may extend through the cone section 103, the nose section 105, the shoulder section 107, and the gage section 109. However, in alternative embodiments, the roller cutter profile 121 may only extend through one or more of the sections.

In one preferred embodiment, as shown in FIG. 5, the roller cutter profile 121 extends beyond the fixed cutter profile 131 in the shoulder section 107 and the gage section 109, while the fixed cutter profile 131 extends beyond the roller cutter profile 121 in the nose section 105 and the cone section 103. In other words, the roller cutter profile 121 is over exposed and the fixed cutter profile 131 is under exposed in the shoulder section 107 and the gage section 109, while the fixed cutter profile 131 is over exposed and the roller cutter profile 121 is under exposed in the nose section 105 and the cone section 103.

Figure 6:
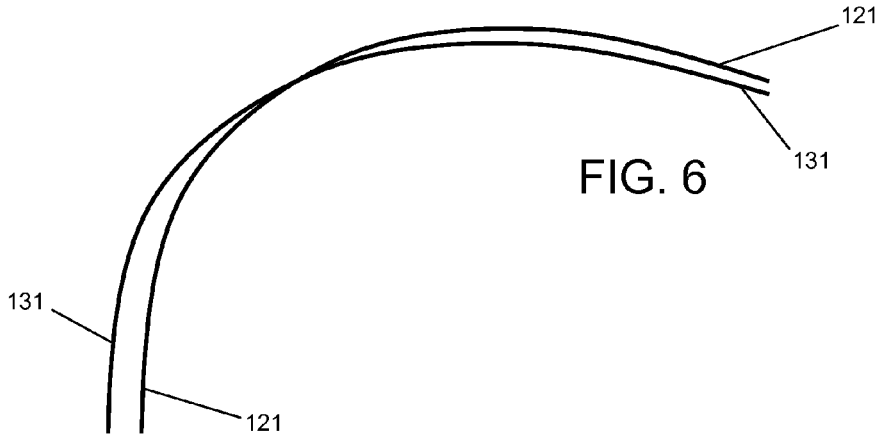
FIG. 6 illustrates a second preferred relationship between a fixed cutter profile and a roller cutter profile utilizing certain aspects of the present inventions.

Referring also to FIG. 6, in an alternative embodiment, the fixed cutter profile 131 extends beyond the roller cutter profile 121 in the shoulder section 107 and the gage section 109, while the roller cutter profile 121 extends beyond the fixed cutter profile 131 in the nose section 105 and the cone section 103. In other words, the fixed cutter profile 131 is over exposed and the roller cutter profile 121 is under exposed in the shoulder section 107 and the gage section 109, while the roller cutter profile 121 is over exposed and the fixed cutter profile 131 is under exposed in the nose section 105 and the cone section 103. As can also be seen in FIG. 6, the profiles 121,131 may be different than those shown in FIG. 5.

Figure 7:
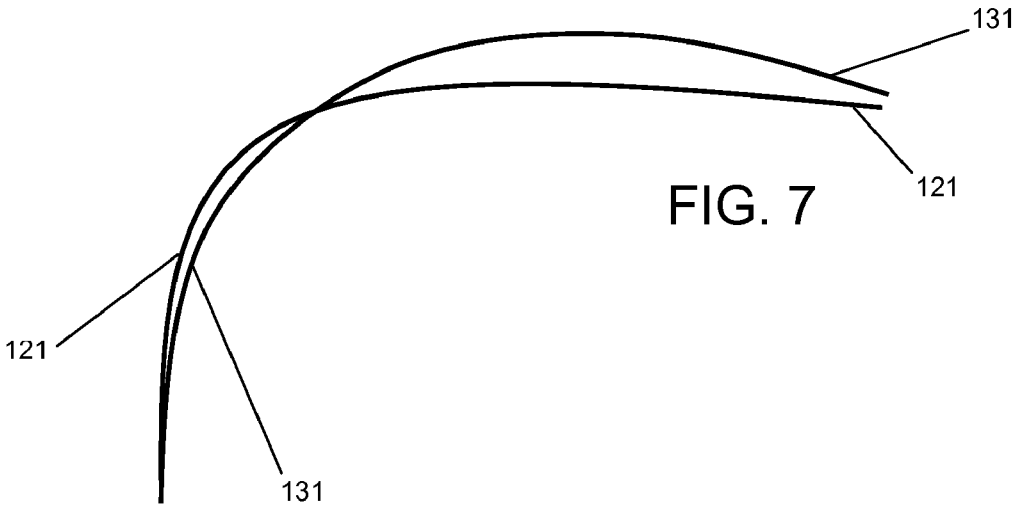
FIG. 7 illustrates a third preferred relationship between a fixed cutter profile and a roller cutter profile utilizing certain aspects of the present inventions.

Referring also to FIG. 7, the fixed cutter profile 131 may extend beyond the roller cutter profile 121 in the cone section 103 and nose section 105, while the roller cutter profile 121 extends beyond the fixed cutter profile 131 in the shoulder section 107 with the fixed cutter profile 131 substantially matching the roller cutter profile 121 in the gage section 109. In other words, the fixed cutter profile 131 may be over exposed and the roller cutter profile 121 under exposed in cone section 103 and the nose section 105, while the roller cutter profile 121 is over exposed and the fixed cutter profile 131 is under exposed in the shoulder section 107 with the fixed cutter profile 131 substantially matching the roller cutter profile 121 in the gage section 109. Thus, the profiles 121,131 may substantially match through any of the sections.

Figure 8:
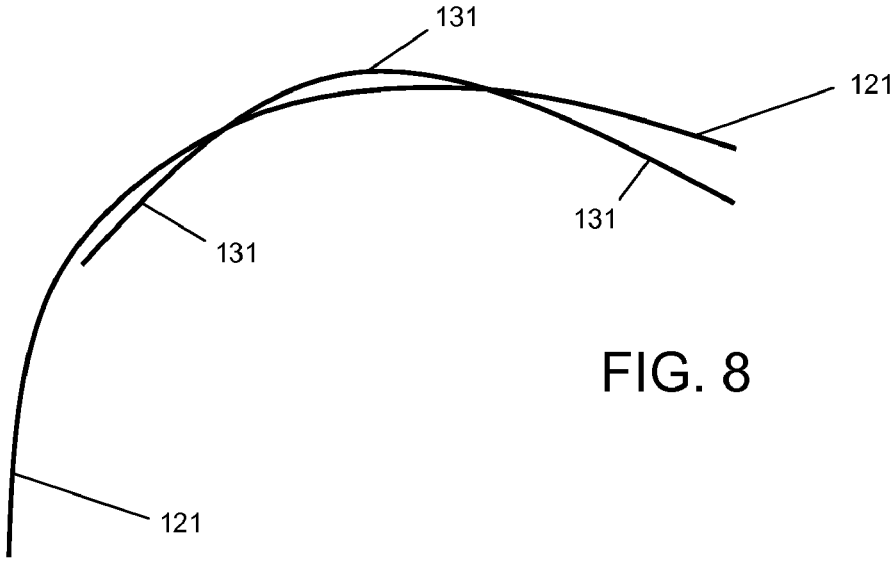
FIG. 8 illustrates a fourth preferred relationship between a fixed cutter profile and a roller cutter profile utilizing certain aspects of the present inventions.

Each profile 121,131 does not necessarily extend through each section. For example, referring also to FIG. 8, the fixed cutter profile 131 may only extend through the cone section 103, nose section 105, and into the shoulder section 107. More specifically, the fixed cutter profile 131 may extend beyond the roller cutter profile 121 in the nose section 105, while the roller cutter profile 121 extends beyond the fixed cutter profile 131 in the cone section 103 and shoulder section 107, with only one of the profiles 121,131 (in this case the roller cutter profile 121) extending through the gage section 109. In other words, the fixed cutter profile 131 may be over exposed and the roller cutter profile 121 under exposed in the nose section 105, while the roller cutter profile 121 is over exposed and the fixed cutter profile 131 is under exposed in the cone section 103 and shoulder section 107, with only one of the profiles 121,131 (in this case the roller cutter profile 121) extending through the gage section 109.

For some applications, these relationships may be swapped. For example, the roller cutter profile may only extend through the cone section 103, nose section 105, and into the shoulder section 107. More specifically, the roller cutter profile may extend beyond the fixed cutter profile in the nose section 105, while the fixed cutter profile extends beyond the roller cutter profile in the cone section 103 and shoulder section 107, with only one of the profiles extending through the gage section. In other words, the roller cutter profile may be over exposed and the fixed cutter profile under exposed in the nose section 105, while the fixed cutter profile is over exposed and the roller cutter profile is under exposed in the cone section 103 and shoulder section 107, with only one of the profiles extending through the gage section 109. While, in this example, the entire relationship between the profiles 121,131 has been swapped with respect to that shown in FIG. 8, some limited portion of any disclosed relationship may be swapped for some applications.

Figure 9:
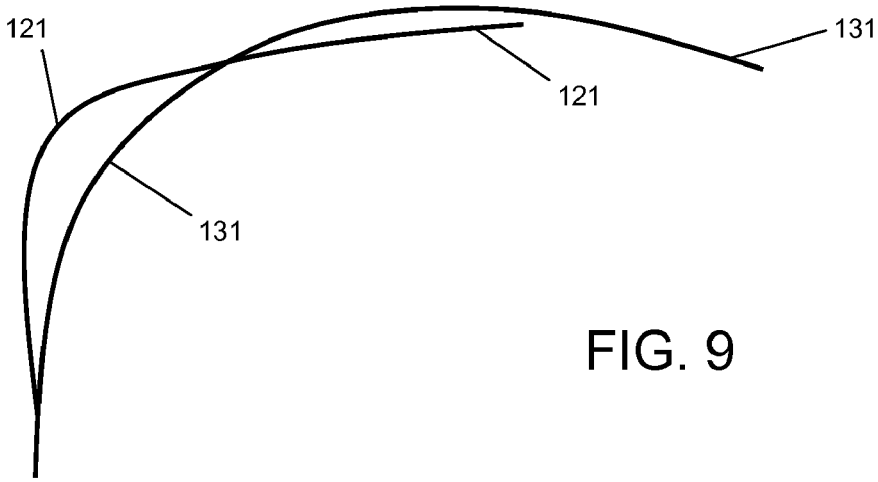
FIG. 9 illustrates a fifth preferred relationship between a fixed cutter profile and a roller cutter profile utilizing certain aspects of the present inventions.

In another embodiment, the roller cutter profile 121 may only extend through the shoulder section 107 and the nose section 105. More specifically, referring also to FIG. 9, the roller cutter profile 121 may extend beyond the fixed cutter profile 131 in the shoulder section 107, while the fixed cutter profile 131 extends beyond the roller cutter profile 121 in the nose section 105, with only one of the profiles 121,131 (in this case the fixed cutter profile 131) extending through the cone section 103 and the gage section 109. In other words, the roller cutter profile 121 may be over exposed and the fixed cutter profile 131 under exposed in the shoulder section 107, while the fixed cutter profile 131 is over exposed and the roller cutter profile 121 under exposed in the nose section 105, with only one of the profiles 121,131 (in this case the fixed cutter profile 131) extending through the cone section 103 and the gage section 109.

It should be clear that the terms over exposed and under exposed, as used throughout this specification, contemplate exposure to the earth formation with respect to the profiles 101,121,131 and/or the bit body 13 or some other component of the bit 11. For example, where the roller cutter profile 121 is described as being over exposed, the roller cutter profile 121 may be over exposed with respect to the fixed cutter profile 131, which may thus be described as under exposed. These differences in exposure may take many forms. For example, in some embodiments, the blades 19 may extend beyond the roller cones 21, or vice versa. Additionally, or alternatively, the roller cutters 25 may be larger than, and thus extend beyond, the fixed cutters 31, or vice versa. In this latter example, the blades 19 may be, but are not necessarily, substantially even with the roller cones 21. Of course, certain applications may incorporate both, and/or other, techniques.

This exposure may be dependant on the size of the bit 11, the size of the cutters 25,31, and/or the application. For example, one profile may be over exposed, with respect to the other profile, by as much as one half inch. In one embodiment, a bit having a diameter of approximately eight and three quarters inches, and sixteen millimeter cutters, may have one profile over exposed with respect to the other profile by up to three tenths of an inch, with a preferred over exposure of approximately fifteen hundredths of an inch. In another embodiment, a bit having a diameter of approximately twelve and one quarter inches, or even sixteen inches, and nineteen millimeter cutters, may have one profile over exposed with respect to the other profile by up to thirty-five hundredths of an inch, with a preferred over exposure of approximately nineteen hundredths of an inch. Of course, in certain applications, one profile may be over exposed, with respect to the other profile, by greater than one half inch.

The above described concepts may be employed on differently sized bits. For example, in one embodiment, the bit 11 is approximately six inches in diameter. As discussed above, the bit 11 may be approximately eight and three quarters inches, twelve and one quarter inches, or even sixteen inches in diameter. Thus, it should be understood that the bit 11 may be of virtually any size, such as between six and sixteen inches in diameter. Of course, in certain applications, the bit 11 may be smaller than six inches or greater than sixteen inches in diameter.

Other and further embodiments utilizing one or more aspects of the inventions described above can be devised without departing from the spirit of Applicant's invention. For example, the relationships between the profiles may be swapped, exchanged, reversed, and/or inverted from that shown and described. Further, the various methods and embodiments of the invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A drill bit comprising:

a bit body;

a plurality of fixed cutting elements secured to the body and defining a fixed cutter profile having at least nose and shoulder sections; and a roller cone rotatably secured to the body, the roller cone having a plurality of roller cone cutting elements defining a roller cutter profile having at least nose and shoulder sections, wherein the fixed cutter profile extends beyond the roller cutter profile in at least one of the sections and the roller cutter profile extends beyond the fixed cutter profile in at least one of the sections.

2. The bit as set forth in claim 1, wherein the roller cutter profile extends beyond the fixed cutter profile in the shoulder section.

3. The bit as set forth in claim 1, wherein the roller cutter profile extends beyond the fixed cutter profile in a gage section.

4. The bit as set forth in claim 1, wherein the fixed cutter profile extends beyond the roller cutter profile in the shoulder section.

5. The bit as set forth in claim 1, wherein the fixed cutter profile extends beyond the roller cutter profile in a gage section.

6. The bit as set forth in claim 1, wherein the roller cutter profile extends beyond the fixed cutter profile in the nose section.

7. The bit as set forth in claim 1, wherein the fixed cutter profile extends beyond the roller cutter profile in the nose section.

8. The bit as set forth in claim 1, wherein the roller cutter profile extends beyond the fixed cutter profile in a cone section.

9. The bit as set forth in claim 1, wherein the fixed cutter profile extends beyond the roller cutter profile in a cone section.

10. An earth boring drill bit comprising:

a bit body;

a plurality of fixed cutting elements secured to the body and defining a fixed cutter profile having cone, nose, shoulder, and gage sections; and a roller cone rotatably secured to the body, the roller cone having a plurality of roller cone cutting elements defining a roller cutter profile having cone, nose, shoulder, and gage sections, wherein the fixed cutter profile extends beyond the roller cutter profile in at least the nose section and the roller cutter profile extends beyond the fixed cutter profile in at least the shoulder section.

11. The bit as set forth in claim 10, wherein the roller cutter profile extends beyond the fixed cutter profile in the shoulder and gage sections.

12. The bit as set forth in claim 10, wherein the fixed cutter profile extends beyond the roller cutter profile in the nose section and the cone section.

13. The bit as set forth in claim 1 the fixed cutter profile having cone, nose, shoulder, and gage sections; and the roller cutter profile having cone, nose, shoulder, and gage sections, wherein the fixed cutter profile extends beyond the roller cutter profile in at least the shoulder section and the roller cutter profile extends beyond the fixed cutter profile in at least the nose section.

14. The bit as set forth in claim 13, wherein the fixed cutter profile extends beyond the roller cutter profile in the shoulder and gage sections.

15. The bit as set forth in claim 13, wherein the roller cutter profile extends beyond the fixed cutter profile in the nose section and the cone section.

* * * * *